US011851923B2

(12) United States Patent
Talpe

(10) Patent No.: US 11,851,923 B2
(45) Date of Patent: Dec. 26, 2023

(54) MAGNETIC LATCH FOR FASTENING A HINGED CLOSURE MEMBER TO A SUPPORT

(71) Applicant: LOCINOX, Waregem (BE)

(72) Inventor: Joseph Talpe, Heestert-Zwevegem (BE)

(73) Assignee: LOCINOX, Waregem (BE)

( * ) Notice: Subject to any disclaimer, the term of this patent is extended or adjusted under 35 U.S.C. 154(b) by 230 days.

(21) Appl. No.: 17/519,853

(22) Filed: Nov. 5, 2021

(65) Prior Publication Data

US 2022/0145663 A1 May 12, 2022

(30) Foreign Application Priority Data

Nov. 6, 2020 (EP) ..... 20206202

(51) Int. Cl.

| | |
|---|---|
| ***E05C 19/16*** | (2006.01) |
| ***E05B 47/00*** | (2006.01) |
| ***E05C 1/00*** | (2006.01) |
| ***E05C 1/08*** | (2006.01) |
| ***E05C 1/10*** | (2006.01) |
| ***E05C 1/16*** | (2006.01) |
| ***E05B 65/00*** | (2006.01) |

(52) U.S. Cl.

CPC ..... *E05C 19/163* (2013.01); *E05B 47/004* (2013.01); *E05B 65/0007* (2013.01); *E05C 1/004* (2013.01); *E05C 1/006* (2013.01); *E05C 1/085* (2013.01); *E05C 1/10* (2013.01); *E05C 1/166* (2013.01)

(58) Field of Classification Search

CPC ..... E05B 47/0038; E05B 47/004; E05B 47/0046; E05C 1/004; E05C 1/006; E05C 1/085; E05C 1/10; E05C 1/166; E05C 19/163

See application file for complete search history.

(56) References Cited

U.S. PATENT DOCUMENTS

| | | | | |
|---|---|---|---|---|
| 5,362,116 | A * | 11/1994 | Doyle | E05C 19/163 292/144 |
| 7,100,405 | B2 * | 9/2006 | West | E05B 65/0007 292/13 |
| 9,303,435 | B2 * | 4/2016 | Simmonds | E05C 19/163 |
| 10,072,442 | B2 * | 9/2018 | Smith | E05C 19/163 |
| 10,641,021 | B2 * | 5/2020 | Schneider | E05C 19/163 |

(Continued)

*Primary Examiner* — Christopher J Boswell

(74) *Attorney, Agent, or Firm* — Morgan, Lewis & Bockius LLP

(57) ABSTRACT

A magnetic latch for fastening a closure member to a support. The magnetic latch comprises a keeper assembly including a magnet and a latch bolt assembly having: an elongated frame (32); a latch bolt (14) moveable between a latching position and a retracted position; a latch bolt biasing member urging the latch bolt into its retracted position; and a latch bolt operating mechanism configured to move the latch bolt from its latching position to its retracted position against a magnetic attraction. The latch bolt operating mechanism comprises: an effort link rod (37); a load link rod (34); and a second-order lever (35) interposed between the effort link rod and the load link rod. The second-order lever reduces the force required to operate the latch bolt operating mechanism thus allowing for an increased magnetic attraction of the latch bolt towards the magnet in the keeper assembly.

14 Claims, 10 Drawing Sheets

(56) References Cited

U.S. PATENT DOCUMENTS

| | | | | |
|---|---|---|---|---|
| 10,794,091 | B2 * | 10/2020 | Smith | E05C 19/163 |
| 2005/0210938 | A1 * | 9/2005 | Doyle | E05C 19/163 70/276 |
| 2011/0148126 | A1 * | 6/2011 | Macernis | E05C 19/163 292/251.5 |
| 2016/0060924 | A1 * | 3/2016 | Singh | E05C 19/163 292/251.5 |
| 2021/0002932 | A1 * | 1/2021 | Schneider | E05C 19/163 |
| 2022/0178182 | A1 * | 6/2022 | Talpe | E05C 19/163 |

* cited by examiner

MAGNETIC LATCH FOR FASTENING A HINGED CLOSURE MEMBER TO A SUPPORT

TECHNICAL FIELD

The present invention relates to a magnetic latch for fastening a hinged closure member to a support.

BACKGROUND ART

A magnetic latch assembly comprises a latch bolt assembly configured to be mounted to one of the hinged closure member and the support and a magnet keeper assembly configured to be mounted to the other one of the hinged closure member and the support. The magnetic latch assembly can be mounted on various types of closure members, in particular a door or a gate. In several countries there are legal regulations for swimming pool gates. Most of these regulations specify a minimum height for the safety gates, a minimum height at which the actuator for opening the closure member are to be located, and/or required minimal and/or maximal force required to actuate the actuator. A common way to meet these requirements is by mounting the latch bolt assembly in an upright position on top of the gate with the actuator on the upper side of the latch bolt assembly. The actuator is typically a knob that has to be pulled upwards in order to open the closure member.

A first kind of known magnetic latch assembly for a hinged closure system comprises a latch bolt assembly and a magnet assembly. The magnet assembly is mounted on the fixed support of the closure system and the latch bolt assembly is mounted on the moveable closure member of the closure system. The latch bolt assembly comprises a horizontal latch bolt that is moveable between an latching position where it may engage the magnet assembly to fasten the closure member and a retracted position where it is retracted within the latch bolt assembly so that the closure member may be opened. A compression spring is disposed around the latch bolt in order to bias the latch bolt to the retracted position. The magnet assembly has a vertical housing with an actuation handle provided on top of the housing and a magnet being positioned near the bottom of the housing. The magnet is coupled to the actuation handle by an elongate bar. The magnet is moveable between an upper position where the magnet cannot sufficiently attract the latch bolt to pull its towards its latching position and a lower position where the magnet can engage the latch bolt to pull its towards its latching position. A compression spring is provided to urge the magnet towards its lower position. Pulling the actuation handle upwards in turn pulls the magnet towards its upper position against the force of the compression spring. When closing the closure member, the latch bolt is attracted by the magnet within the magnet assembly, which magnet is in its lower position, and is displaced to its latching position against the force of the compression spring thus engaging the magnet assembly and fastening the closure member. When actuating the handle, the magnet is moved to its upper position thus increasing the distance between the magnet and the latch bolt and decreasing the magnetic attraction so that the compression spring pulls the latch bolt to its retracted position to open the closure member.

Such assemblies are disclosed in AU 2009/251007 A1, AU 2013/206766 A1, 2014/203446 A1, AU 2016/201778 A1, and AU 2018/256525 A1.

AU 2013/206766 A1 further discloses that safety may be improved by having an actuation handle that may only be pulled upwards after a central area within the handle has been depressed. More specifically, depressing the central handle area causes a pawl to be horizontally displaced thereby allowing an upwards movement of the elongate bar. Additional safety measures are also disclosed in AU 2014/203446 A1 where the actuation handle requires a rotational motion followed by an upwards pulling motion in order to move the magnet towards its upper, i.e. disengaged, position.

A downside of such improved safety measures is that the opening requires a series of complicated motions which may be difficult for a user to execute.

AU 2016/201778 A1 and AU 2018/256525 A1 further disclose that the latch bolt assembly is provided with a key cylinder that may be used to lock the latch bolt. The main purpose of the key cylinder is to lock the latch bar in its latching position such that the closure member cannot be opened by the magnet assembly.

A downside of these locking mechanism is that the latch bolt mechanism is positioned quite low and may be in reach of children. Moreover, the locking mechanism is used to lock the latch bar in its latching position. This may pose a danger in case a user locks the locking mechanism while the gate is opened as this may prevent the latch bolt from entering the keeper and thus leave the gate unfastened.

General downsides of the first kind of magnetic latch assemblies is that the distance between the gate and the support is crucial. More specifically, the latch bolt and the magnet need to be very carefully aligned in order for the latch bolt to be attracted. As such, a careful height and width placement are required which is time consuming. Consequently, when the gate sags or otherwise moves somewhat, the distance between the permanent magnet and the latch bolt will become immediately so great that the magnetic attraction will no longer be able to attract the latch bolt against the tension of the compression spring and the gate will thus no longer be latched. A regular check-up and adjustment of the mutual position of the keeper assembly and of the latch bolt assembly is thus required.

Another downside is that the knob may be difficult to lift. More specifically, the force required to lift the knob in combination with the height at which the knob is positioned may make it difficult for a user (in particular a user of low height) to unfasten the closure member.

Another downside is that the magnet and the latch bolt are unlocked in a sideways fashion. More specifically, the magnet is pulled sideways with respect to the direction in which the latch bolt is attracted thereto. Such sideways motion typically requires a smaller force when compared to moving the latch bolt in the opposite direction of the magnetic attraction. This small force also means that the knob may be more easily lifted which may be a safety concern as children may be able to lift the knob.

A second kind of magnetic latch assembly for a hinged closure system comprises a magnet assembly mounted on the closure member and a latch bolt assembly mounted on the fixed post. The magnet assembly includes a striker that is fixed to the closure member and has a free end which partially extends beyond the closure member towards the support. The striker acts as a stop against the fixed post with a magnet being provided in the free end thereof. The latch bolt assembly includes a vertically oriented latch bolt moveable between an latching position and a retracted position with a compression spring urging the latch bolt to its retracted position and with the magnet pulling the latch bolt to its latching position to fasten the closure member. A pull knob is provided on the latch bolt assembly and is connected to the latch bolt via a link bar to allow the latch bolt to be pulled into its retracted position against the force of the magnet to open the closure member. A key cylinder is provided on the latch bolt assembly to allow to lock the latch bolt in its latching position. More specifically, the key cylinder is positioned besides the link bar and rotation of the cylinder causes the cylinder to interlock with a groove provided in the link bar.

Such assemblies are disclosed in WO 92/03631 A1, WO 03/067004 A1, US 2005/210938 A1, WO 2014/127413 A1, WO 2014/127398 A1, and WO 2014/127399 A1.

WO 03/067004 A1 additionally discloses a second operating mechanism which is separate from the pull knob and its associated key cylinder. The second operating mechanism is positioned at a lower height and includes a front and/or a rear push button, each of which allows to open the closure member. At least the front push button (i.e. the side of the closure member on the outside of the gated area) is provided with a key cylinder, keypad or the like that prevents operating the push button when locked. In order to allow various actuation mechanism to operate together, a multi-component latch arm is disclosed. The latch arm includes a lower link with a mounting plate at the bottom. The compression spring engages the mounting plate on one end and the latch bolt at the other end. The latch arm also includes an upper link that is slideably engaged with the lower link. Depressing either push button or pulling the knob at the top causes the upper link to move upwards thereby pulling the lower link upwards causing the latch bolt to be retracted. More specifically, the push buttons cause a grooved plate to move horizontally with the upper link being guided in the grooves which are under an angle of 45° thus transferring the horizontal movement of the plate into a vertical movement of the upper link.

WO 03/067004 A1 additionally discloses the use of L-shaped mounting brackets to mount the latch bolt assembly to the support. Each L-shaped mounting bracket has a plurality of openings positioned above one another such that the latch bolt assembly housing may be positioned at a fixed number of different vertical positions with respect to the housing. Bolts are placed transversely through the housing and the L-shaped mounting brackets to fix the housing to the L-shaped mounting brackets.

A downside of the mounting assembly is that height adjustments require removing the housing from the closure system and reattaching it at a different height. This is a time-consuming operation as all transverse bolts need to be unfastened and fastened again.

US 2005/210938 A1 discloses that the link bar extends from the knob and is placed through an opening in a top side of a link, the link being formed by a beam-shaped frame. Likewise, the latch bolt extends upwards with its upper end being placed through an opening in the bottom side of the link and the compression spring engages the latch bolt and the bottom side of the link. The link has a sufficient vertical height such that the knob can be fully depressed and the latch bolt fully retracted while the ends of the link bar and the latch bolt do not engage. The link and link bar may also be substituted by a flexible element. In either embodiment, the knob falls back down due to gravity after being released independently from the operation of the compression spring and the latch bolt.

WO 2014/127399 A1 discloses that the vertically oriented housing of the latch bolt assembly may be provided with means enabling to mount latch accessories onto the housing. To this end, the outside of the housing is provided with front and rear coupling portions. The front coupling portion allows mounting latch accessories, while the back coupling portion acts as a mounting section to mount the latch bolt assembly on the fixed support of the closure system. Latch accessories may include a replaceable cover, a decorative banner, electronic sensors (e.g. an alarm when the closure member is being opened), or alternative operating means (e.g. a door handle). The door handle is attached to a lever arm that extends horizontally towards the link bar. The link bar is provided with projections that engage with the lever arm. Actuation of the door handle causes a rotation of the lever arm which in turn results in an upwards motion of the link bar thus retracting the latch bolt.

WO 2014/127398 A1 relates to the key cylinder positioned near the knob, which key cylinder may prevent movement of the link bar. The key cylinder is positioned adjacent the link bar but in a horizontal configuration. Rotation of the key cylinder (i.e. actuating the key cylinder by turning the key) causes a first lock member to rotate. The first lock member is provided with a single external screw thread that engages a corresponding groove provided on a second lock member. In this way, the rotational motion of the key cylinder is transferred into a sliding motion of the second lock member. The second lock member is provided with a lip and the knob is provided with a corresponding groove. By actuating the key cylinder, the lip of the second lock member engages the groove provided on the knob thus preventing an upwards movement of the knob, effectively locking the closure member in its fastened position.

A downside of this locking mechanism is that the locking mechanism is used to lock the latch bar in its latching position. This may pose a danger in case a user locks the locking mechanism while the gate is opened as this may prevent the latch bolt from entering the keeper and thus leave the gate unfastened.

A drawback of the second kind of magnetic latch assemblies is that a person who wants to open the gate has to have both hands free as he has to pull the bolt of the latching device with one of his hands upward and at the same time he has to open the gate with his other hand. A further drawback of this known latching device is that the keeper assembly has to be positioned perfectly underneath the latch bolt in order to be able to draw the latch bolt by magnetic attraction into the retaining element. Consequently, when the gate sags or otherwise moves somewhat, the distance between the permanent magnet and the latch bolt will become immediately so great that the magnetic attraction will no longer be able to attract the latch bolt against the tension of the compression spring and the gate will thus no longer be latched. A regular check-up and adjustment of the mutual position of the keeper assembly and of the latch bolt assembly is thus required.

Another drawback of the second kind of magnetic latch assemblies is that the key cylinder is placed adjacent the link bar and knob so the latch bolt assembly becomes rather bulky. Moreover, the key cylinder is only accessible from one side of the closure system.

DISCLOSURE OF THE INVENTION

It is an object of the present invention to at least partially alleviate one or more of the above-mentioned disadvantages.

The present invention is defined by the appended claims.

In a first aspect of the present disclosure, a magnetic latch for fastening a closure member to a support is disclosed, the magnetic latch comprising a latch bolt assembly configured to be mounted to one of the closure member and the support and a keeper assembly configured to be mounted to the other one of the closure member and the support, the keeper assembly comprising a first magnetic element and the latch bolt assembly comprising: an elongated frame extending in a vertical direction and having two opposing extremities; a latch bolt mounted on the frame at a first one of said two extremities and being moveable between a latching position and a retracted position, the latch bolt comprising a second magnetic element; a latch bolt biasing member arranged to urge the latch bolt into its retracted position, wherein the first magnetic element and the second magnetic element are configured to magnetically attract each other to move the latch bolt into its latching position against the latch bolt biasing member; and a latch bolt operating mechanism including an actuator mounted on the frame at a second one of said two extremities, the latch bolt operating mechanism being configured to, upon actuation of the actuator, move the latch bolt from its latching position to its retracted position against the magnetic attraction between said first and said second magnetic element, the latch bolt operating mechanism comprising: an effort link rod extending in the vertical direction and coupled to the actuator and moveable by a translational motion along the vertical direction from a rest position to an actuated position upon actuation of the actuator; a load link rod extending in the vertical direction and coupled to the latch bolt and moveable by a translational motion along the vertical direction from a rest position to an actuated position upon actuation of the actuator; and a second-order lever interposed between the effort link rod and the load link rod and rotatable about a fulcrum mounted on the frame between a rest position and an actuated position, wherein the second-order lever has a fulcrum with the load link rod being closer to the fulcrum than the effort link rod.

In an alternative first aspect of the present disclosure, a magnetic latch for fastening a closure member to a support is disclosed, the magnetic latch comprising a latch bolt assembly configured to be mounted to one of the closure member and the support and a keeper assembly configured to be mounted to the other one of the closure member and the support, the latch bolt assembly comprising: a latch bolt moveable between a latching position and a retracted position, the latch bolt comprising a first magnetic element; and a latch bolt biasing member arranged to urge the latch bolt into its retracted position, the keeper assembly comprising: an elongated frame extending in a vertical direction and having two opposing extremities; a second magnetic element mounted on the frame at a first one of said two extremities and being moveable between a rest position in which the first magnetic element and the second magnetic element magnetically attract each other to move the latch bolt into its latching position against the latch bolt biasing member and an actuated position; and an operating mechanism including an actuator mounted on the frame at a second one of said two extremities, the operating mechanism being configured to, upon actuation of the actuator, move the second magnetic element from its rest position to its actuated position, the operating mechanism comprising: an effort link rod extending in the vertical direction and coupled to the actuator and moveable by a translational motion along the vertical direction from a rest position to an actuated position upon actuation of the actuator; a load link rod extending in the vertical direction and coupled to the second magnetic element and moveable by a translational motion along the vertical direction from a rest position to an actuated position upon actuation of the actuator; and a second-order lever interposed between the effort and the load link rod and rotatable about a fulcrum mounted on the frame between a rest position and an actuated position, wherein the second-order lever has a fulcrum with the load link rod being closer to the fulcrum than the effort link rod.

Both these aspects have the same advantage, namely that the first and/or second magnetic element may be provided with a stronger magnetic attraction. In other words, the latch bolt will be magnetically attracted from a further distance and with a greater force. This is advantageous as it allows for more leeway between the position of the keeper assembly and the latch assembly. In other words, even if the closure member sags or otherwise moves somewhat, the increased magnetic attraction ensures that the latch bolt is attracted against the tension of the compression spring. In particular, the latch bolt may be attracted from distances exceeding 10 mm. A regular check-up and adjustment of the mutual position of the keeper assembly and of the latch bolt assembly is thus also avoided. The increased magnetic attraction is possible due to the second-order lever. More specifically, this second-order lever reduces the force required to unfasten the closure member, i.e. the second-order lever has a fulcrum with the load link rod being closer to the fulcrum than the effort link rod. This force reduction is beneficial since, otherwise, the increased magnetic attraction would make it very difficult and cumbersome to lift the actuator.

In the alternative first aspect, the magnetic latch is of the kind disclosed in AU 2009/251007 A1, AU 2013/206766 A1, 2014/203446 A1, AU 2016/201778 A1, and AU 2018/256525 A1.

In an embodiment of the first aspects of the present disclosure, the magnetic attraction between the magnetic elements is generally between 40 and 150 N, preferably between 50 and 100 N, and more preferably between 60 and 90 N. The second-order lever then reduces this force such that the actuator may be actuated by a force between 15 and 60 N, preferably between 20 and 50 N, and more preferably between 25 and 45 N. In this way, the magnetic attraction force is maximized while still allowing the actuator to be actuated with a relatively low force.

In an embodiment of the first aspects of the present disclosure, the second-order lever is rotatable in a plane between its rest position and its actuated position, the plane having a component in the vertical direction and in a horizontal direction, the second-order lever being slideable in the horizontal direction with respect to effort link rod and/or the load link rod and/or the frame. This allows for the link rods to remain entirely vertical during actuation since the horizontal movement component (which component is always present in a rotational motion) is effected by the second-order lever.

In a preferred embodiment of the first aspects of the present disclosure, the second-order lever comprises a fulcrum opening, an effort opening, and a load opening, the fulcrum being disposed in the fulcrum opening, the effort link rod being connected to the second-order lever by a transverse pin disposed in the effort opening and the load link rod being connected to the second-order lever by a transverse pin disposed in the load opening. In this way, the link rods always engage the second-order lever irrespective of the direction of movement which would not be the case if the link rods would abut against an outer surface of the second-order lever. This increases the robustness and reliability of the magnetic latch and improves its operation.

In a more preferred embodiment of the first aspects of the present disclosure, at least two of the fulcrum opening, the effort opening, and the load opening are elongated in the horizontal direction. Elongated openings are a convenient way in order to allow the second-order lever to move horizontally with respect to the link rods, which, as described above, is advantageous as the link rods may remain entirely vertical during actuation.

In an embodiment of the first aspects of the present disclosure, the second-order lever comprises a fulcrum opening, an effort opening, and a load opening, the fulcrum being disposed in the fulcrum opening, the effort link rod being connected to the second-order lever by a transverse pin disposed in the effort opening and the load link rod being connected to the second-order lever by a transverse pin disposed in the load opening. In this way, the link rods always engage the second-order lever irrespective of the direction of movement which would not be the case if the link rods would abut against an outer surface of the second-order lever. This increases the robustness and reliability of the magnetic latch and improves its operation.

In an embodiment of the first aspects of the present disclosure, the latch bolt operating mechanism further comprises a slideable coupler disposed between the load link rod and the latch bolt and moveable, by a translational motion along the vertical direction, between a releasing position in which the load link rod does not engage the slideable coupler and an engaging position in which the load link rod engages the slideable coupler, and in that the releasing position of the slideable coupler corresponds to the retracted position of the latch bolt and the engaging position of the slideable coupler corresponding to the extended position of the latch bolt. The slideable coupler in fact allows to disengage the actuator from the latch bolt. More specifically, the actuator may be in its rest position while the latch bolt is in its retracted position (i.e. unlatched). As such, once the user releases the actuator, the actuator may return to its rest position, while the latch bolt remains in its retracted position such that the closure member may close without interference from a latch bolt in its latching position.

In an embodiment of the first aspects of the present disclosure, the actuator is directly connected to the effort link rod. Preferably, the actuator is connected to the effort link rod by an angular snap-fit joint, the actuator preferably comprising an internal chamber into which a locally widened end of the effort link rod is positioned. A direct connection simplifies the design by avoiding unnecessary connection parts. Moreover, an angular snap-fit joint is a robust connection which is invisible from the outside of the latch bolt assembly.

In an embodiment of the first aspects of the present disclosure, the latch bolt is moveable in the vertical direction between its latching position and its retracted position by a translational motion along the vertical direction. The magnetic latch is thus of the kind disclosed in WO 92/03631 A1, WO 03/067004 A1, US 2005/210938 A1, WO 2014/127413 A1, WO 2014/127398 A1, and WO 2014/127399 A1.

In a preferred embodiment of the first aspects of the present disclosure, the latch bolt operating mechanism further comprises a slideable coupler disposed between the load link rod and the latch bolt and moveable, by a translational motion along the vertical direction, between a releasing position in which the load link rod does not engage the slideable coupler and an engaging position in which the load link rod engages the slideable coupler, and in that the releasing position of the slideable coupler corresponds to the retracted position of the latch bolt and the engaging position of the slideable coupler corresponding to the extended position of the latch bolt, that latch bolt being fixedly connected to the slideable coupler. The slideable coupler in fact allows to disengage the actuator from the latch bolt. More specifically, the actuator may be in its rest position while the latch bolt is in its retracted position (i.e. unlatched). As such, once the user releases the actuator, the actuator may return to its rest position, while the latch bolt remains in its retracted position such that the closure member may close without interference from a latch bolt in its latching position.

In a more preferred embodiment of the first aspects of the present disclosure, the latch bolt comprises a circumferential groove, the latch bolt being connected to the slideably coupler by a pin which is partially positioned within the circumferential groove. A circumferential groove is easy to manufacture in a cylindrical latch bolt and does not significantly weaken the latch bolt (especially when compared to a through opening). Moreover, since the latch bolt is typically made from pure iron (in order to be magnetically attracted to a magnet in the keeper assembly) and the magnetic latch is meant for outdoors use, a surface treatment is required to prevent latch bolt corrosion. This surface treatment is easier to apply in a circumferential groove as compared to a through opening.

In a more preferred embodiment of the first aspects of the present disclosure, the latch bolt biasing member comprises a compression spring having a first end engaging the slideable coupler and a second end engaging the frame. A compression spring is an easy to manufacture element which is known to operate in a satisfactory fashion in outdoor applications in particular. Moreover, the behaviour of a compression spring during compression and relaxation is well-known and may be tailored to the specific force required.

In a second aspect of the present disclosure, a magnetic latch for fastening a closure member to a support is disclosed, the magnetic latch comprising a latch bolt assembly configured to be mounted to one of the closure member and the support and a keeper assembly configured to be mounted to the other one of the closure member and the support, the keeper assembly comprising a first magnetic element and the latch bolt assembly comprising: an elongated frame extending in a vertical direction and having two opposing extremities; a latch bolt mounted on the frame at a first one of said two extremities and being moveable between a latching position and a retracted position, the latch bolt comprising a second magnetic element, wherein the first magnetic element and the second magnetic element are configured to magnetically attract each other to move the latch bolt into its latching position; a latch bolt operating mechanism including an actuator mounted on the frame at a second one of said two extremities, the latch bolt operating mechanism having a driving part which is moveable, upon actuation of the actuator, by a first translational motion along a first direction from a rest position to an actuated position to move the latch bolt from its latching position to its retracted position against the magnetic attraction and by a second translational motion along a second direction, opposite to said first direction, to move from its actuated position to its rest position; and a locking mechanism mounted on the frame to lock the driving part in its rest position, the locking mechanism comprising: a key actuated cylinder mounted on the frame and having a rotary driving bit which is rotatable upon actuation of the key actuated cylinder along a locking direction and an unlocking direction, opposite to said locking direction; and a locking member mounted on the frame and moveable between an unlocking position in which the driving part is moveable along said first and said second translational motion, and a locking position in which, when the driving part is in its rest positon, it locks the driving part in its rest position, the rotary driving bit being arranged to engage the locking member to move it between its locking position and its unlocking position.

The locking member is directly actuated by the key cylinder such that the locking mechanism may be made in a simpler fashion compared to that in the known magnetic latch disclosed in WO 2014/127398 A1 which requires a motion conversion mechanism to drive the locking member.

In an embodiment of the second aspect of the present disclosure, the locking member comprises: a pawl mounted on the frame and moveable between a retracted position in which the driving part is moveable along said first and said second translational motion, and an extended position in which, when the driving part is in its rest positon, it locks the driving part in its rest position; a pawl locking member mounted on the frame and moveable between a locking position in which it locks the pawl in its retracted position, and an unlocking position in which it releases the pawl, the rotary driving bit being arranged to engage the pawl locking member to move it between its locking position and its unlocking position; and a biasing member urging the pawl into its extended position, wherein, when the pawl locking member is in its unlocking position and the drive part is in its actuated position, the pawl is urged into its retracted position by said second translational motion of the drive part. In this embodiment, the pawl and the pawl locking member ensure that the actuator is not fixed in its actuated position in case the locking mechanism would be locked while the actuator is in its actuated position. More specifically, as the pawl is moveable with respect to the pawl locking member, the motion of the drive part (which is connected to the actuator) urges the pawl in its retracted position. Once the drive part has passed the pawl, the biasing member urges the pawl against the pawl locking member to its locking position.

In a preferred embodiment of the second aspect of the present disclosure, the biasing member is interposed between the pawl and the pawl locking member. Preferably, the biasing member is a torsion spring. This is a robust design since the pawl is urged into a correct position with respect to the pawl locking member which is driven by the key cylinder. A torsion spring is an easy to manufacture element which is known to operate in a satisfactory fashion in outdoor applications in particular. Moreover, the behaviour of a torsion spring during compression and relaxation is well-known and may be tailored to the specific force required.

In a preferred embodiment of the second aspect of the present disclosure, the pawl locking member comprises an abutment surface, the biasing member urging the pawl into engagement with the abutment surface. This is a robust and reliable design since the pawl is urged into a correct position with respect to the pawl locking member.

In a preferred embodiment of the second aspect of the present disclosure, the pawl locking member is pivotally connected to the frame, in particular by a transverse pin, to pivot between its locking and its unlocking position and/or the pawl is pivotally mounted on the pawl locking member, in particular by a transverse pin, to pivot between its extended and its retracted position. Using pivotal connections provides a simpler latch bolt since all motions related to the locking mechanism are of a rotational nature and no sliding parts are thus required.

In a preferred embodiment of the second aspect of the present disclosure, the locking position of the locking member corresponds to the pawl locking member being in its locking position and the pawl being in its extended position and the unlocking position of the locking member corresponds to the pawl locking member being in its unlocking position and the pawl being in its retracted position. In other words, the position of the pawl locking member determines the possible state of the pawl. More specifically, when the pawl locking member is unlocked, the pawl is always retracted and, when the pawl locking member is locked, the pawl is extended but may be urged aside by the motion of the drive part when going from its actuated to its res position.

In a preferred embodiment of the second aspect of the present disclosure, the pawl comprises a pushing surface, the drive part pushing against the pushing surface to urge the pawl to its retracted position when the pawl locking member is in its unlocking position and the drive part is in its actuated position. Such a pushing motion may be the automatic side-effect of the actuator (which is connected to the drive part) returning to its rest position under the influence of gravity. The use of a dedicated pushing surface provides a greater design flexibility in order to ensure that the pawl is pushed aside reliably (e.g. by using an inclined surface).

In an embodiment of the second aspect of the present disclosure, the frame comprises a first guide member, in particular a transverse pin, and the locking member comprises a second guide member, in particular a groove, the guide members being arranged to guide the locking member between its locking and its unlocking position. The guiding member improve the robustness and reliability of the magnetic latch as it is avoided that the locking member would be displaced into an undesired position which could lead to damaging and/or blocking the magnetic latch.

In a preferred embodiment of the second aspect of the present disclosure, the second guide member comprises a first end region, a second end region and a central part, the central part being delimited by flexible walls and separated by a distance which is smaller than the width of the first guide member. In this way, the flexible walls provide a bi-stable pawl locking member since the first guide member is urged towards either one of the end regions. Moreover, a user will also feel and/or hear a certain click when the first guide member reaches one of the end regions thus providing feedback to the user on the successful opening or closing of the locking mechanism.

In an embodiment of the second aspect of the present disclosure, the frame has a width direction and a depth direction that are substantially perpendicular to one another and to the vertical direction, the key actuated cylinder extending through the frame in the depth direction. The provides for a compact and less bulky design compared to the known latches disclosed in WO 2014/127398 A1 and EP 1657383 B1 as the key cylinder is no longer adjacent the link rod, but extends through the frame. Moreover, the key cylinder is now accessible from both sides of the closure member.

In a preferred embodiment of the second aspect of the present disclosure, the rotary driving bit is positioned substantially in the centre of the frame in the depth direction. This allows to use commonly available key cylinder (e.g. a single-barrel euro-profile cylinder) in combination with the magnetic latch. Moreover, this provides a well-balanced system and minimizes potential torque-related effects that could be caused by exerting forces on opposing sides of the frame.

In a preferred embodiment of the second aspect of the present disclosure, the driving part comprises: a top part extending in the vertical direction and coupled to the actuator, which top part; a bottom part extending in the vertical direction and coupled to the latch bolt, the top part and the bottom part being separated by a distance in the depth direction; and a bridge part extending in the depth direction and connected to the top part on one side and the bottom part on the other side. Preferably, the bottom part comprises a groove through which the key actuated cylinder extends. This allows to place the top part centrally in the frame and the bottom part close to one side of the frame thereby providing room for the rotary driving bit of the key cylinder. The groove in the bottom part is beneficial as this results in a stronger bottom part when compared to a bottom part that only has a single leg.

In a more preferred embodiment of the second aspect of the present disclosure, the locking member, in its locking position, engages the bridge part to it lock the driving part in its rest position. The locking member may thus also be placed centrally with respect to the frame thus providing a well-balanced system and minimizing potential torque-related effects that could be caused by exerting forces on opposing sides of the frame.

It will be readily appreciated that, as will also become evident from the further description, that the above mentioned aspects of the disclosure and the various embodiments (incl. preferred, more preferred, advantageous, more advantageous, alternative, etc. embodiment and/or other optionally indicated features) should not be limited to individual elements, but may be combined with one another to achieve even other embodiments than those already described, which embodiments may also be part of the present invention as defined in the appended claims.

BRIEF DESCRIPTION OF THE DRAWINGS

The invention will be further explained by means of the following description and the appended figures.

DESCRIPTION OF THE INVENTION

Figure 1:
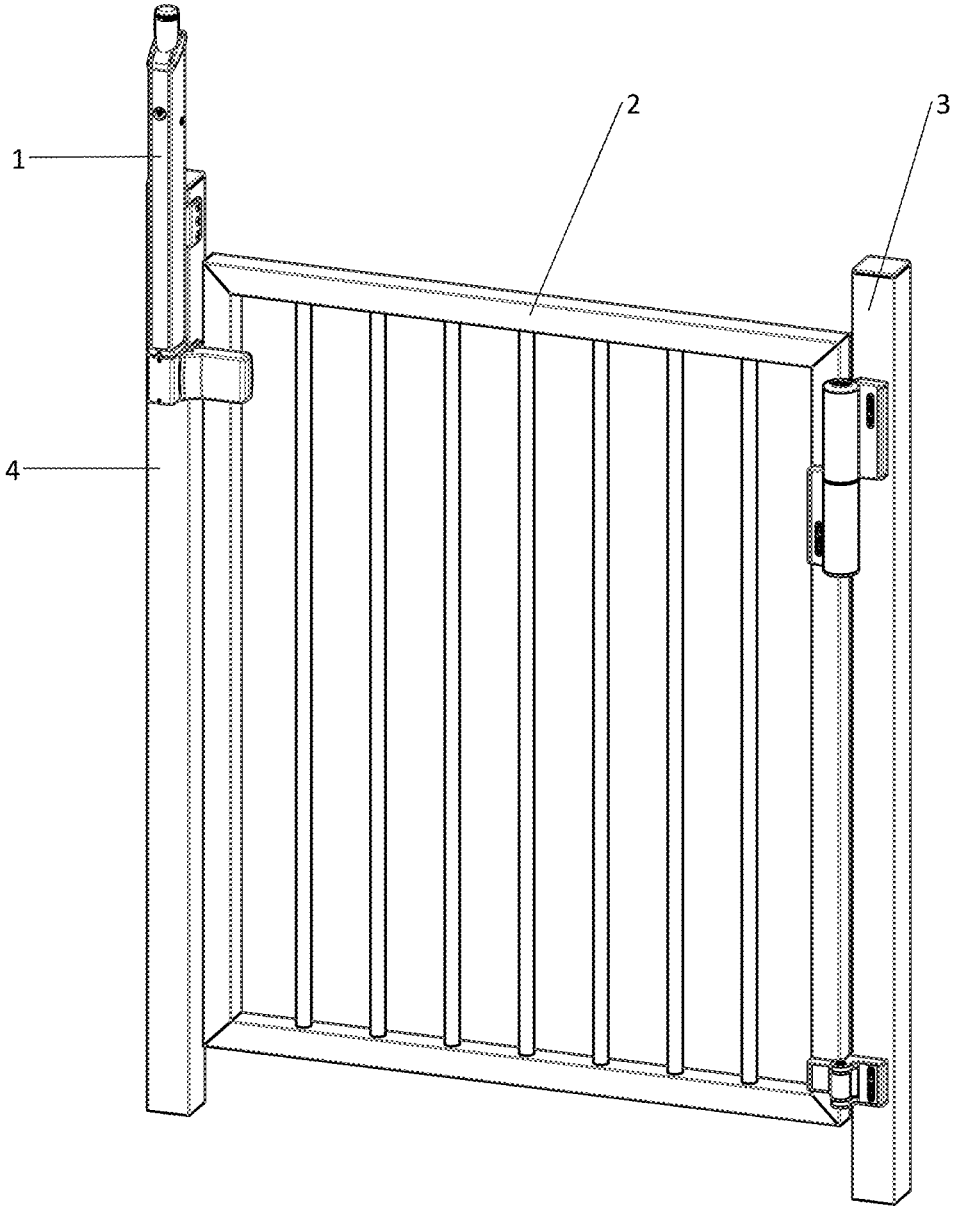
FIG. 1 shows a perspective view of an embodiment of a magnetic latch assembly mounted on a closure system.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the various embodiments, although referred to as "preferred" are to be construed as exemplary manners in which the invention may be implemented rather than as limiting the scope of the invention.

FIG. 1 shows a perspective view of a first embodiment of a magnetic latch assembly 1 mounted on a closure system. The closure system comprises a closure member 2 that is hinged on a first support 3 and that may be fastened to a second support 4 by means of the magnetic latch assembly 1. In the illustrated embodiment, the closure member 2 is formed by a gate and the supports 3, 4 are formed by fixed posts, but it will be readily appreciated that the magnetic latch assembly 1 is also suitable for other kinds of closure members (e.g. a sliding closure member, a door, etc.) and/or supports. For example, the support may be formed by a closure member in case the magnetic latch assembly 1 is used on a double gate.

Figure 2:
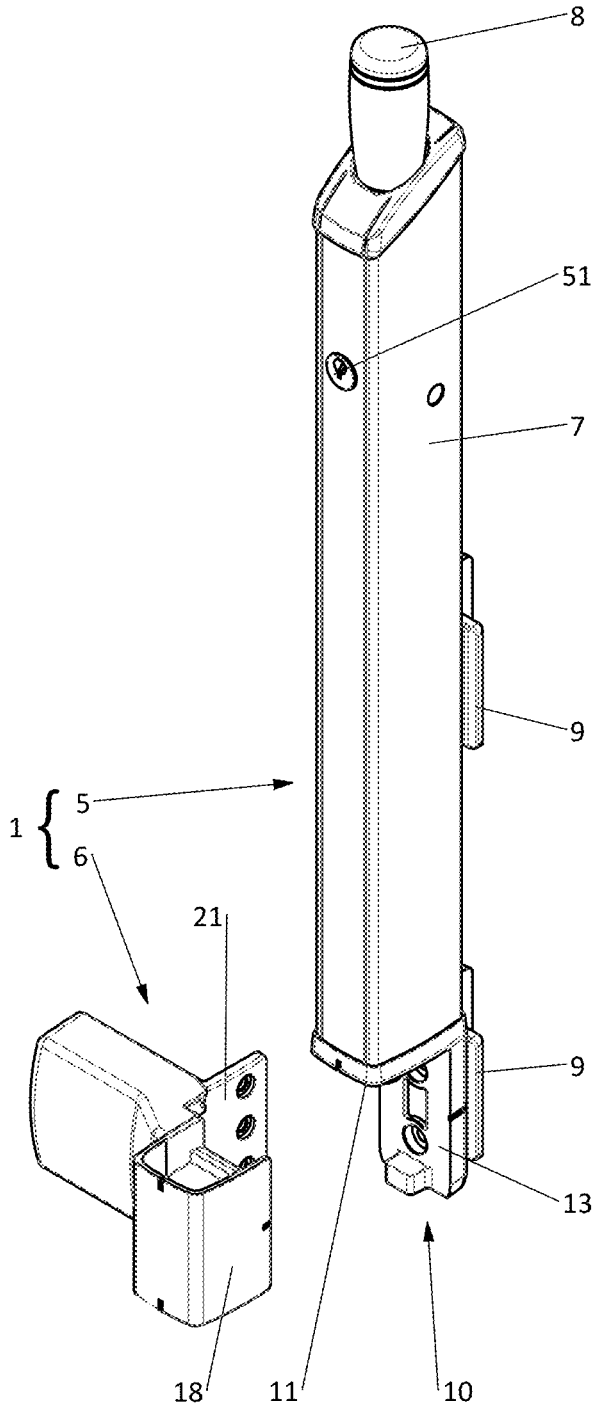
FIG. 2 shows a perspective view of the latch bolt assembly and the magnetic keeper assembly that form the magnetic latch assembly of FIG. 1.

The magnetic latch assembly 1 generally comprises a latch bolt assembly 5 and a magnetic keeper assembly 6 as shown in FIG. 2. In the illustrated embodiment, the latch bolt assembly 5 is mounted on the support 4 and the magnetic keeper assembly 6 is mounted on the closure member 2, but it will be readily appreciated that these may be reversed. As shown in FIG. 2, the latch bolt assembly 5 comprises a vertically oriented elongated housing 7 with a pull knob 8 protruding from the top thereof. The housing 7 is mounted on the closure member 2 using two L-shaped mounting brackets 9. Preferably, the height of the housing 7 with respect to the mounting brackets 9 is adjustable in order to vertically align the latch bolt assembly 5 mounted on the support 4 to the magnetic keeper assembly 6 mounted on the closure member 2. At the bottom of the housing 7, there is provided an L-shaped bracket 10 having one leg 11 fastened to the bottom of the housing using screws 12 (see FIG. 3A) and a second leg 13 which is located opposite the magnetic keeper assembly 6 and to which the bottom L-shaped mounting bracket 9 is fastened. The L-shaped bracket 10 is open at both sides in order to engage with the magnetic keeper assembly 6 on either side such that the latch bolt assembly 5 is operable for both right-handed and left-handed closure members 2 without any modifications. It will be readily appreciated that the elongated housing 7 may be regarded as a frame on which the various components of the latch bolt assembly are mounted. The operation of the latch bolt assembly 5 will be described in more detail by reference to FIGS. 3A to 8C. The magnetic keeper assembly 6 will be described in more detail by reference to FIGS. 9A to 9C.

Figure 3A:
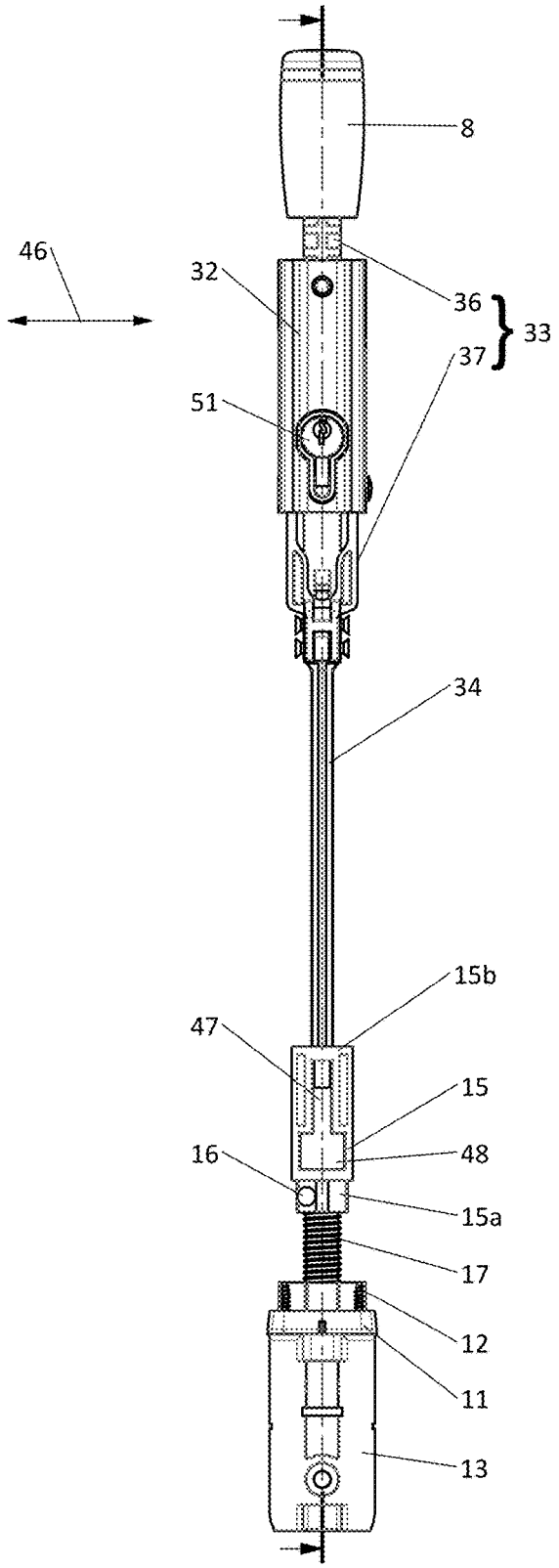
FIG. 3A shows a front view of the latch bolt assembly of FIG. 2 with the housing having been removed and with the latch bolt in its latched state.
Figure 3B:
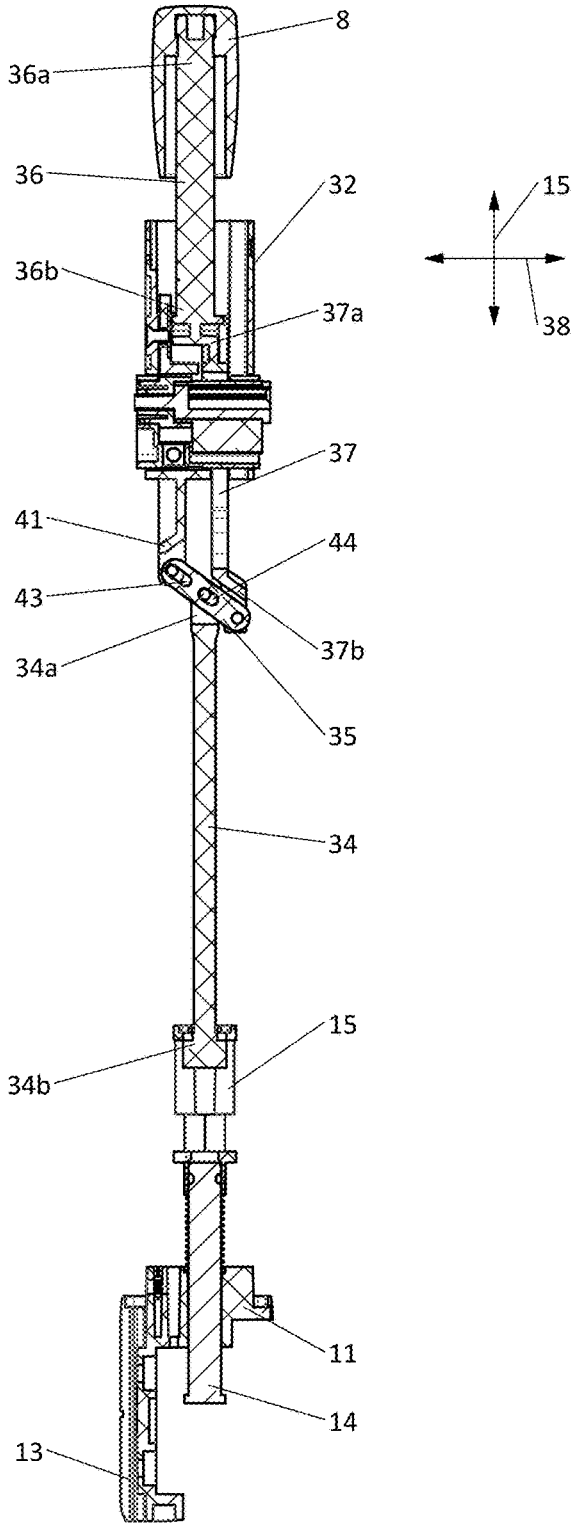
FIG. 3B shows a cross-section through the latch bolt assembly along plane 'A' indicated in FIG. 3A.

FIGS. 3A and 3B show the latch bolt assembly 5 in its latched position, i.e. where the closure member 2 is fastened to the support 4. The latch bolt assembly 5 comprises a latch bolt 14 at its bottom. More specifically, the latch bolt 14 extends through the first leg 11 of the L-shaped bracket 10 and is moveable in the vertical direction 15 between an extended position (shown in FIGS. 3A and 3B) and a retracted position (shown in FIGS. 4A to 5B). The latch bolt 14, at its upper end 14*a*, is fixedly connected to a slideable coupler 15, in particular to the lower end 15*a* thereof, in particular by a transversely positioned pin 16. More specifically, the latch bolt 14 is provided with a circumferential groove (best shown in FIG. 3A) and the transversely positioned pin 16 (e.g. a rivet) partially engages part of this circumferential groove. A latch bolt spring 17 is positioned between the coupler 15 and the top side of the L-shaped bracket 10. In the illustrated embodiment, the latch bolt spring 17 is a compression spring which urges the upper end of the latch bolt 14 upwards, i.e. away from the top side of the L-shaped bracket 10. As such, the latch bolt 14 is urged by the latch bolt spring 17 towards the retracted position.

Figure 9C:
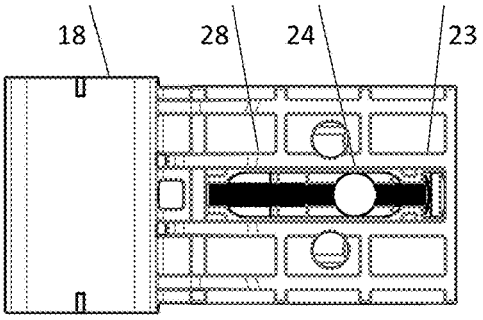
FIG. 9C shows a rear side view of the magnetic keeper assembly of FIG. 2.
Figure 9B:
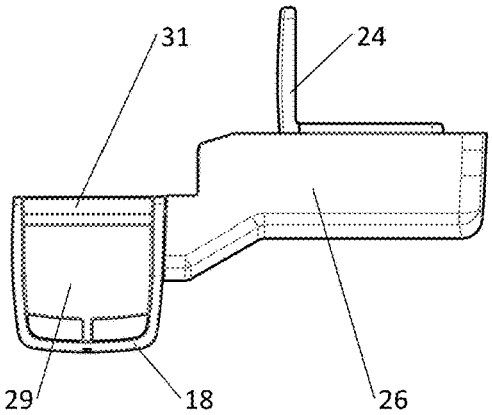
FIG. 9B shows a top view of the magnetic keeper assembly of FIG. 2.
Figure 9A:
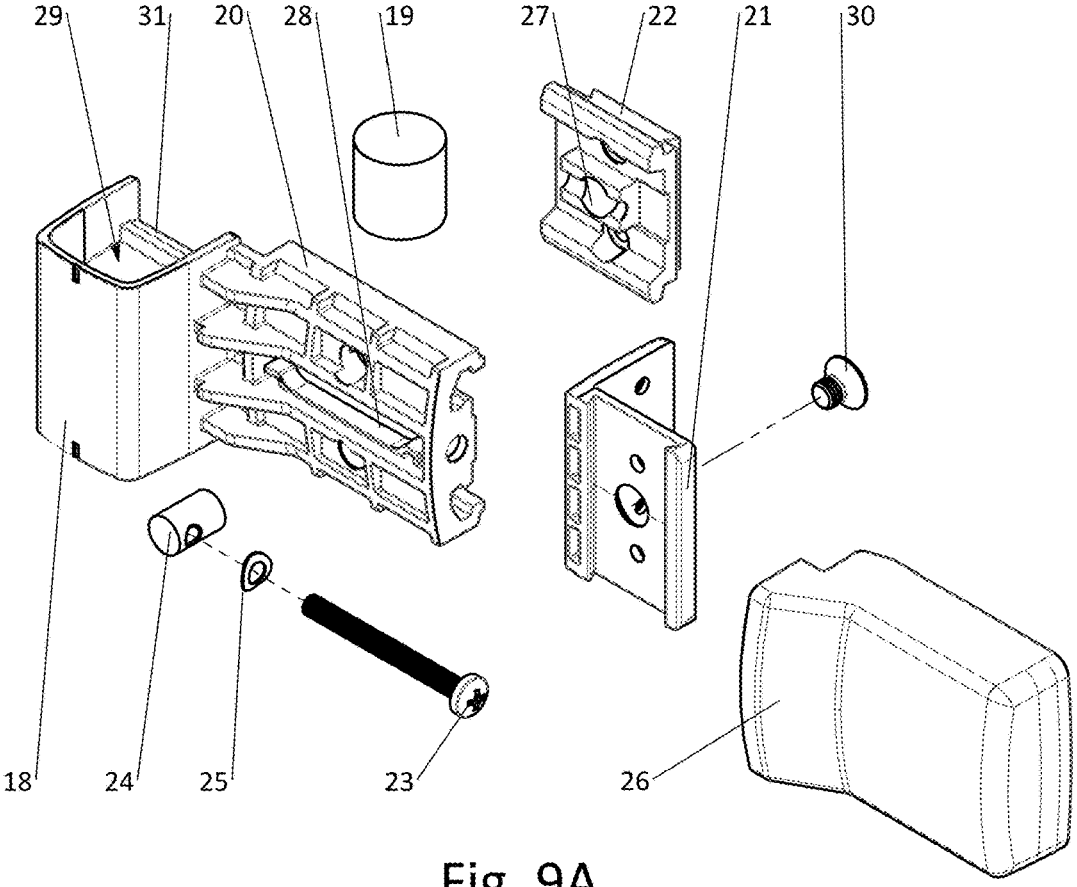
FIG. 9A shows an exploded view of the magnetic keeper assembly of FIG. 2.

The magnetic keeper assembly 6 is shown in an exploded view in FIG. 9A and comprises a keep 18 which houses a magnet 19, in particular a permanent magnet, although it will be readily appreciated that an electromagnet is also feasible. The keep 18 has an elongated part 20 on its side in order to allow the keep 18 to be mounted on the closure member 2 by means of an L-shaped mounting bracket 21. More specifically, the L-shaped mounting bracket 21 is mounted to the closure member 2 and a horizontal guide 22 is mounted directly on the L-shaped mounting bracket 21 (and fixed thereto by means of screw 30) with the elongated part 20 of the keep 18 being mounted on the horizontal guide 22. A setting screw 23 and corresponding setting nut 24 are provided in order to horizontally adjust the position between the keep 18 and the horizontal guide 22. More specifically, the setting nut 24 is positioned on one side within a corresponding hole 27 on the horizontal guide and with the other side in a horizontal groove 28 in the elongated part 20. The setting nut 24 is provided with an internal screw thread corresponding to that of the setting screw 23. A rotation of the setting screw 23 causes the setting nut 24 to slide along the length of the setting screw 23 (as best shown in FIG. 9C) thus causing the keep 18 to slide horizontally with respect to the horizontal guide 22 that is fixedly positioned on the closure member 2. This allows to correctly position the keep 18, in particular the latch bolt receiving area 29, with respect to the latch bolt assembly 5 mounted on the support 4. A curved washer 25 may be provided between the setting screw 23 and the setting nut 24. A cover 26 is provided in order to finish the magnetic keeper assembly 6.

When the closure member 2 is closed (as illustrated in FIG. 1), the magnet 19 provided in the magnetic keeper assembly 6 exerts a force on the latch bolt 14 thereby attracting the latch bolt 14 against the force of the latch bolt spring 17 to its latching position. As such, the latch bolt 14 is manufactured from a ferromagnetic material, preferably iron. When the latch bolt 14 is in its latching position, it, in particular its lower end 14*b*, is kept by the keep 18, in particular in the latch bolt receiving area 29, the magnetic keeper assembly 6 in order to fasten the closure member 2 to the support 4. More specifically, when the latch bolt 14 is in its latched position in the keeper 18, the bottom part of the latch bolt 14, when attempting to open the closure member 2, pushes against the bounding wall 31 of the latch bolt receiving area 29.

The latch bolt assembly 5 is generally provided with a latch bolt operating mechanism which allows to retract the latch bolt 14 against the force of the magnet 19 in order to unfasten the closure member 2 with respect to the support 4. In the illustrated embodiment, the latch bolt operating mechanism comprises a frame 32 that is fixed to the housing 7, the knob 8 at the top of the housing 7, an upper link rod 33 connected to a lower link rod 34 by a lever 35.

The upper link rod 33 comprises a top part 36 and a bottom part 37 connected by a horizontal plate 39 such that these parts 36, 37 are located in a different position when viewed in the depth direction 38 (see FIG. 3B) of the latch bolt assembly 5. The reasons as to why the upper link rod 33 is so split will be described below with reference to FIGS. 6 to 8C. The top part 36 of the upper link rod 33 has an upper end 36*a* on which the knob 8 is fixed and a lower end 36*b* that is fixed on the horizontal plate 39. The bottom part 37 of the upper link rod 33 has an upper end 37*a* that is fixed on the horizontal plate 39 and a lower end 37*b* that is connected to the lever 35.

In the illustrated embodiment, the knob 8 is fixed to the upper end 36*a* of the upper link rod 33 by an angular snap-fit joint. The angular snap-fit joint is best shown in FIG. 3B. The angular snap-fit joint comprises a chamber within the knob 8, which chamber has a larger cross-section at the top and a smaller cross-section at the bottom. The upper end 36*a* of the upper link rod 33 has a corresponding locally thicker part. When assembling the latch bolt assembly 5, the knob 8 is slid onto the upper link rod 33 of which the thicker top part is compressed and the re-expands to fill the chamber. This provides a robust connection which is moreover invisible from the outside of the magnetic latch 1. In the illustrated embodiment, the knob 8 is made from metal, while the upper link rod 33 is made from a plastic material.

The lever 35 has a first end 35*a*, a central part 35*b*, and a second end 35*c*. The lower end 37*b* of the bottom part 37 of the upper link rod 33 is connected to the first end 35*a* of the lever 35 by means of a pin 40 transversely placed extending through openings (not shown) in the lower end 37*b* of the bottom part 37 of the upper link rod 33 and the first end 35*a* of the lever 35. The frame 32 has a vertically oriented protrusion 41 which has a upper end 41*a* fixed to the frame 32 and a lower end 41*b* which is connected to the second end 35*c* of the lever 35 by means of a pin 42 transversely placed extending through an opening (not shown) in the lower end 41*b* of the protrusion 41 and through an elongated opening 43 in the second end 35*c* of the lever 35. The central part 35*b* of the lever 35 also has an elongated opening 44 used for connecting the upper end 34*a* of the lower link rod 34 to the lever 35 by means of a pin 45 transversely placed extending through an opening (not shown) in the upper end 34*a* of the lower link rod 34 and through the elongated opening 44.

Figure 4A:
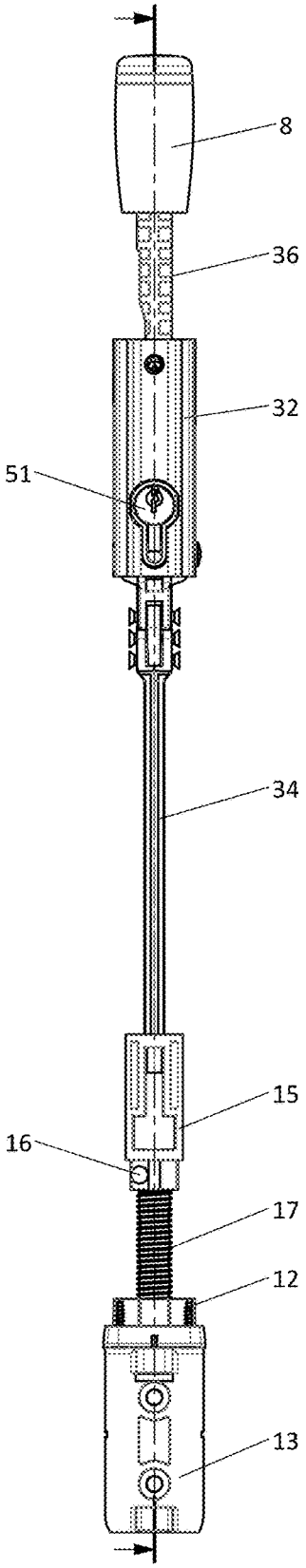
FIG. 4A shows a front view of the latch bolt assembly of FIG. 2 with the housing having been removed and with the latch bolt in its retracted state and the knob in its actuated position.
Figure 4B:
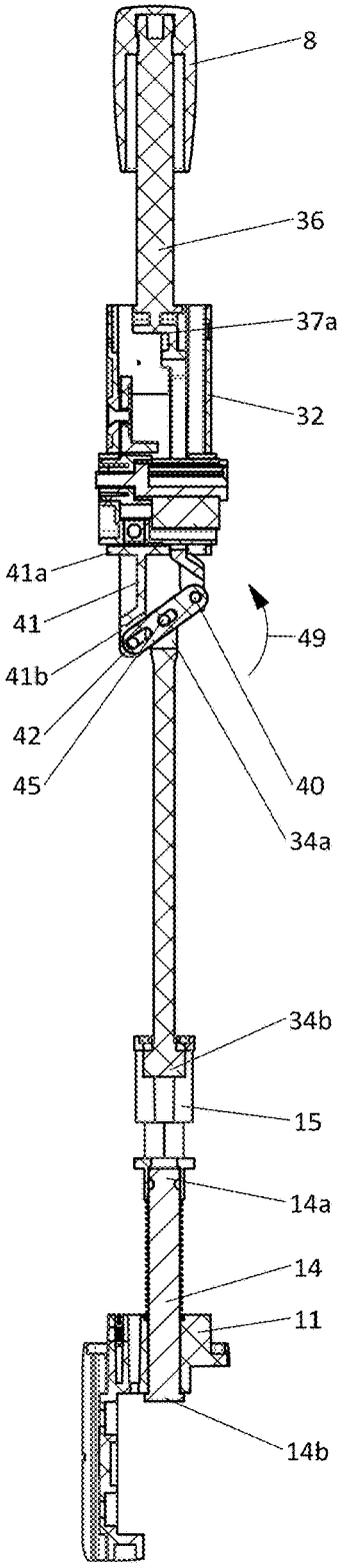
FIG. 4B shows a cross-section through the latch bolt assembly along plane 'A' indicated in FIG. 4A.

The lever 35 is rotatable about its second end 35*c* between a rest position (shown in FIGS. 3A, 3B, 5A and 5B) and an actuated position (shown in FIGS. 4A and 4B). More specifically, the first end 35*a* of the lever 35 is able to rotate, in particular over an angle of about 90°, with respect to the transverse pin 42 around the width direction 46 (indicated in FIG. 3A). The elongated openings 43, 44 allow the upper link bar 33 and the lower link bar 34 to remain vertically oriented during the rotation of the lever 35 as the lever 35 can slide in the depth direction 38 with respect to the lower end 37*b* of the upper link bar 33 and the upper end 34*a* of the lower link bar 34, which sliding motion would not be possible in case the openings 43, 44 were circular.

The lower link rod 34 has a lower end 34*b* that engages the slideable coupler 15. More specifically, the upper end 15*b* of the coupler 15 has an opening (not shown) through which the lower link rod 34 extends. The lower end 34*b* of the lower link rod 34 is so shaped that it cannot pass through the opening in the upper end 15*b* of the coupler 15 as best in FIG. 3B. The coupler 15 has a vertically oriented groove 47 and the lower end 34*b* is guided in this groove 47. The coupler 15 is slideable between a lower position (shown in FIGS. 3A and 3B) and an upper position (shows in FIGS. 4A to 5B). The lower position of the coupler 15 corresponds to the latched position of the latch bolt 14 and the upper position of the coupler 15 corresponds to the retracted position of the latch bolt 14 because the upper end 14*a* of the latch bolt 14 is fixed to the lower end 15*a* of the coupler 15 as described above. The coupler 15 further has an opening 48 adjacent the groove 47, which opening 48 allows to place the coupler 15 on the lower end 34*b* of the lower link rod 34.

Figure 5A:
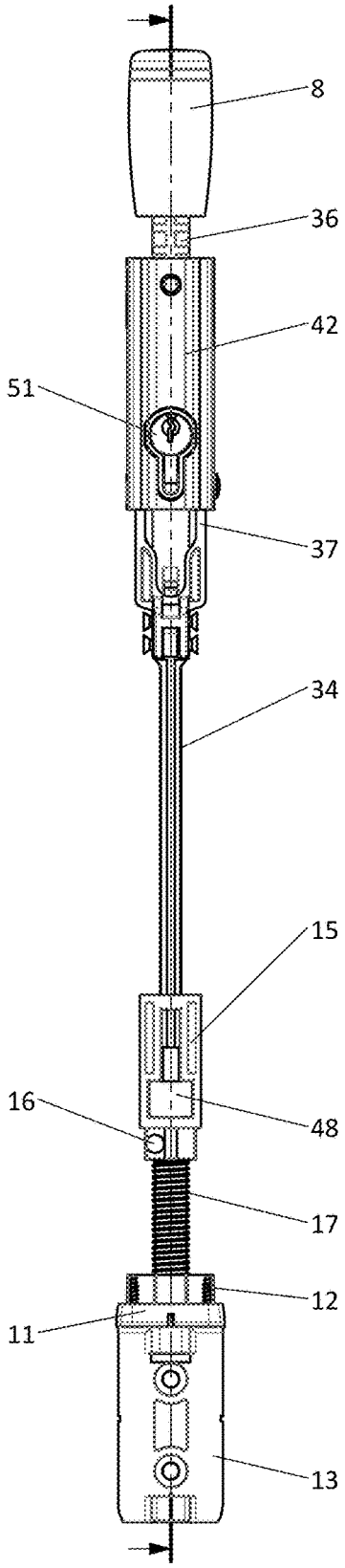
FIG. 5A shows a front view of the latch bolt assembly of FIG. 2 with the housing having been removed and with the latch bolt in its retracted state and the knob in its rest position.
Figure 5B:
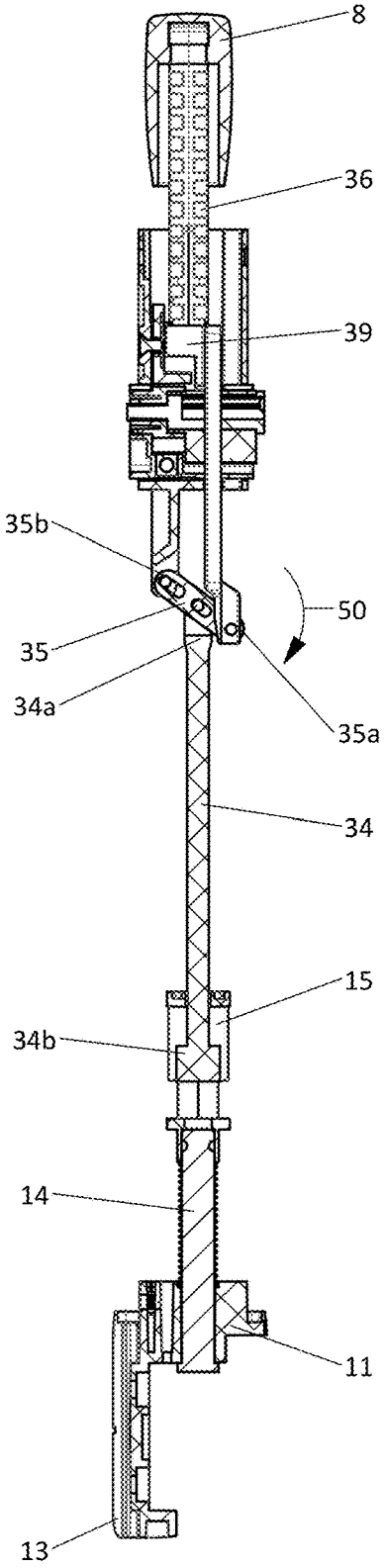
FIG. 5B shows a cross-section through the latch bolt assembly along plane 'A' indicated in FIG. 5A.
Figure 6:
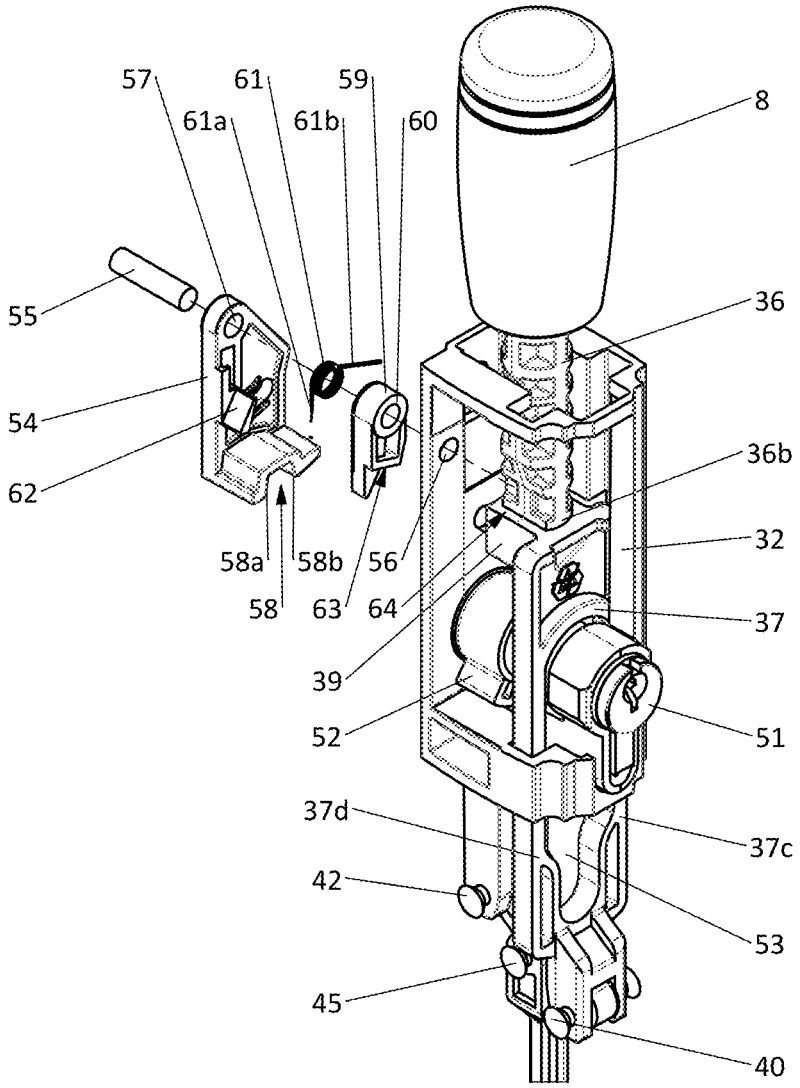
FIG. 6 shows a perspective, partially exploded, view of the top part of the latch bolt assembly of FIG. 2 with the housing having been removed and with the knob in its rest position.

The latch bolt assembly 5 operates in the following way. FIGS. 3A and 3B show the latch bolt 14 in its latching position due to the magnetic attraction from the magnet 19 in the magnetic keep assembly 6. When a user desires to open the closure member 2, the user pulls the knob 8 upwards from its rest position to its actuated position as shown in FIGS. 4A and 4B. The upwards movement of the knob 8 causes the upper link rod 33 to move upwards (i.e. the upper link rod 33 undergoes an upwards translational motion) thereby rotating the first end 35*a* of the lever 35 in a first rotational direction 49 and pulling the lower link rod 34 upwards (i.e. the lower link rod 34 undergoes an upwards translational motion). Because the lower end 34*b* of the lower link rod 34 is abutting the upper end 15*b* of the coupler 15, the coupler 15 is pulled upwards which in turn pulls latch bolt 14 upwards to its retracted position (i.e. the latch bolt 14 and the coupler 15 undergo an upwards translational motion). Once the latch bolt 14 is in its retracted position, the closure member 2 is unfasted and the user may open the closure member 2 and the knob 8 may be let go. Gravity will cause the knob 8 to fall downwards to its rest position as shown in FIGS. 5A and 5B. The downwards movement of the knob 8 causes the upper link rod 33 to move downwards (i.e. the upper link rod 33 undergoes a downwards translational motion) thereby rotating the first end 35*a* of the lever 35 in a second rotational direction 50 (which is opposite to the first rotational direction 49) and pushing the lower link rod 34 downwards (i.e. the lower link rod 34 undergoes a downwards translational motion). Since the lower end 34*b* of the lower link rod 34 is free to slide within the groove 47 in the coupler 15, the coupler 15 is not affected by the motion of the lower link rod 34. Rather, the coupler 15 remains in its upper position due to the latch bolt spring 17 thus keeping the latch bolt 14 in its retracted state. When the closure member 2 is again closed (either due to the user or due to the provision of self-closing means, e.g. a self-closing hinge), the magnet 19 again attracts the latch bolt 14 thus pulling the latch bolt 14 and the coupler 15 downwards (i.e. the latch bolt 14 and the coupler 15 undergo a downwards translational motion) against the latch bolt spring 17 to the configuration shown in FIGS. 3A and 3B.

The force required to unfasten the closure member 2 is effectively determined by the magnetic field strength H of the magnet 19, the shape of the latch bolt 14 and the configuration of the lever 35. Increasing the magnetic field strength H increases the force exerted on the latch bolt 14. A likewise effect may be achieved by increasing the volume of the latch bolt 14 as this also increases the magnet force exerted thereon. However, this results in a bulkier latch bolt assembly 5 which is undesired. A higher attraction force is beneficial as this allows to attract the latch bolt 14 from greater distances thus allowing more leeway between the support 4 and the closure member 2. However, a downside of a higher attraction force is that the user has to exert a higher force on the knob 8 in order to retract the latch bolt 14. The lever 35 alleviates this effect since it causes a force reduction between the lower link rod 34 and the upper link rod 33. In other words, the lever 35 is a second-order lever with the upper link 33 being the effort and the lower link 34 being the load and the transverse pin 42 forming the fulcrum.

In the illustrated embodiment, the magnet 19 is a neodymium magnet with 22 kg of retaining force and a height and diameter of 25 mm. The magnet 19 exerts an attraction force on the latch bolt 14 (which latch bolt 14 has a diameter of 12 mm in the illustrated embodiment, but other diameters are possible) between 65 and 70 N and the lever 35 reduces the force such that the knob 8 can be lifted by applying a pulling force between 30 and 40 N. However, other force values are also possible. In general, the force required to pull the knob 8 is between 15 and 60 N, preferably between 20 and 50 N, and more preferably between 25 and 45 N. The magnetic attraction force exerted on the latch bolt 14 is preferably as large as possible and may generally be between 40 and 150 N, preferably between 50 and 100 N and more preferably between 60 and 90 N. This allows to attract the latch bolt 14 from distances exceeding 10 mm thus allowing more leeway between the support 4 and the closure member 2.

The latch bolt assembly 5 is also provided with a key cylinder 51 that allows to lock the closure member 2 in its fastened position with respect to the support 4. In other words, the key cylinder 51 is part of a locking mechanism that prohibits movement operation of the latch bolt operating mechanism. The locking mechanism will be described with respect to FIGS. 6 to 8C. The key cylinder 51 is a Euro-cylinder corresponding to standard DIN 18252/2006 (as shown in FIGS. 3B, 4B and 5B) which may be operated from either side of the closure member 2 and has a single rotary driving bit 52 centrally positioned with respect to the key cylinder 52. However, other kinds of key cylinder 51 (e.g. a key-in-knob cylinder) are known to the skilled person and may also be used in the latch bolt assembly.

Figure 8A:
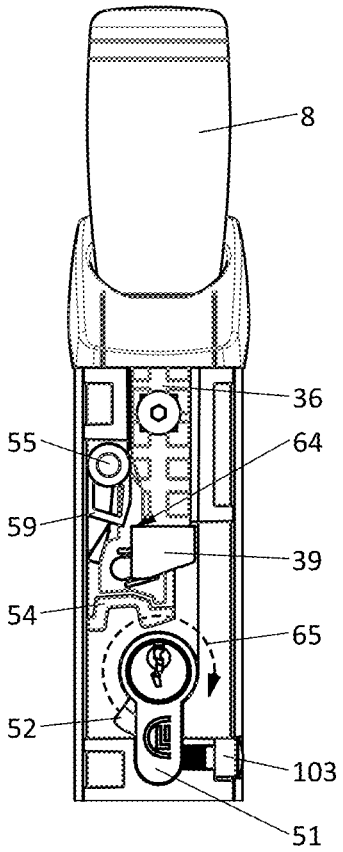
FIGS. 8A to 8C show the same configuration as FIGS. 7A to 7C with a front view.
Figure 8B:
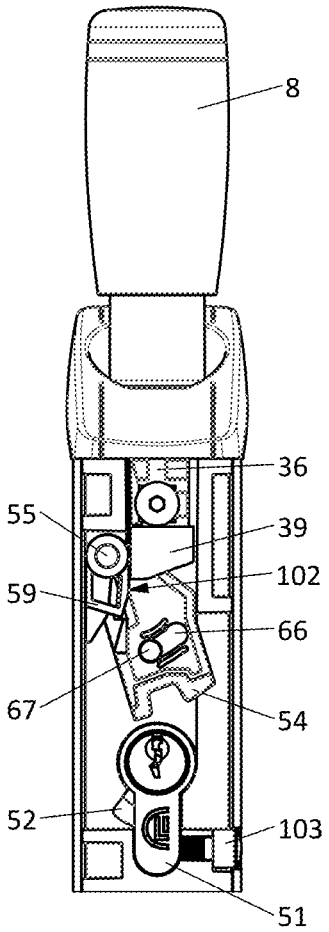
Figure 8C:
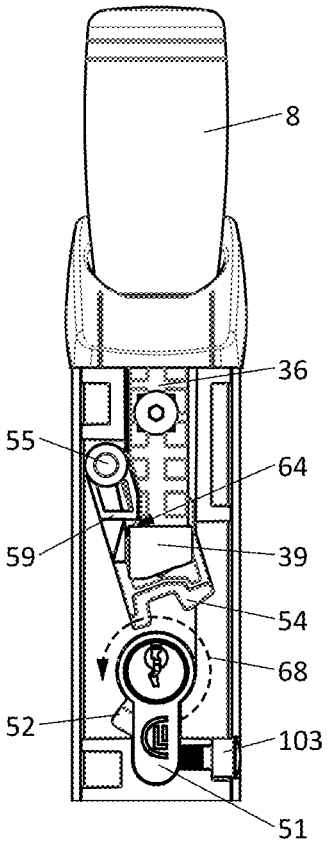

The key cylinder 51 is fixed to the frame 32 by a transversely positioned bolt 103 shown in FIGS. 8A to 8C. The key cylinder 51 is placed centrally with respect to the housing 7 of the latch bolt assembly 5. This central placement is possible due to the specific shape of the upper link rod 33. More specifically, the bottom part 37 of the upper link rod 33 has two parallel legs 37*c*, 37*d* with a groove 53 provided therebetween. The key cylinder 51 extends through this groove 53 and the groove 53 is substantially elongated to allow the bottom part 37 of the upper link rod 33 to slide with respect to the frame 32 as required for the normal operation of the latch bolt operating mechanism described above. Furthermore, the bottom part 37 of the upper link rod 33 is positioned more closely to the frame 32 with respect to the top part 36 of the upper link rod 33. This provides the required space for the rotary driving bit 52 of the key cylinder 51 which may freely rotate adjacent to the bottom part 37 of the upper link rod 33. An alternative would be to make the groove 37 wider to allow a rotation of the rotary driving bit 52. In this way, the top part 36 and the bottom part 37 of the upper link rod 33 may be placed in the same plane, however this increases the width of the latch bolt assembly 5, meaning that the latch bolt assembly 5 is quite bulky and has to be wider than the support 4 which is undesired.

The locking mechanism comprises a pawl locking member 54 that is mounted on the frame 32 by a transverse pin 55 that is placed through an opening 56 in the frame 32, an opening 57 in the pawl locking member 54 and into a hole (not shown) provided in the frame 32. The pin 55 forms a pivot around which the pawl locking member 54 is rotatable between a first position (shown in FIGS. 7A and 8A) and a second position (shown in FIGS. 7B, 7C, 8B and 8C). The pawl locking member 54 is guided between its two positions by means of a curved slot 66 and a cooperating pin 67 (shown in FIG. 8B). The pin 67 is fixed to the frame 32 and movement of the pawl locking member 54 beyond its two positions is prevented as the pin 67 engages the ends of the slot 66. The bottom part of the pawl locking member 54 has a groove 58 formed by two sidewalls 58*a*, 58*b* in a shape corresponding to that of the rotary driving bit 52.

Figure 10:
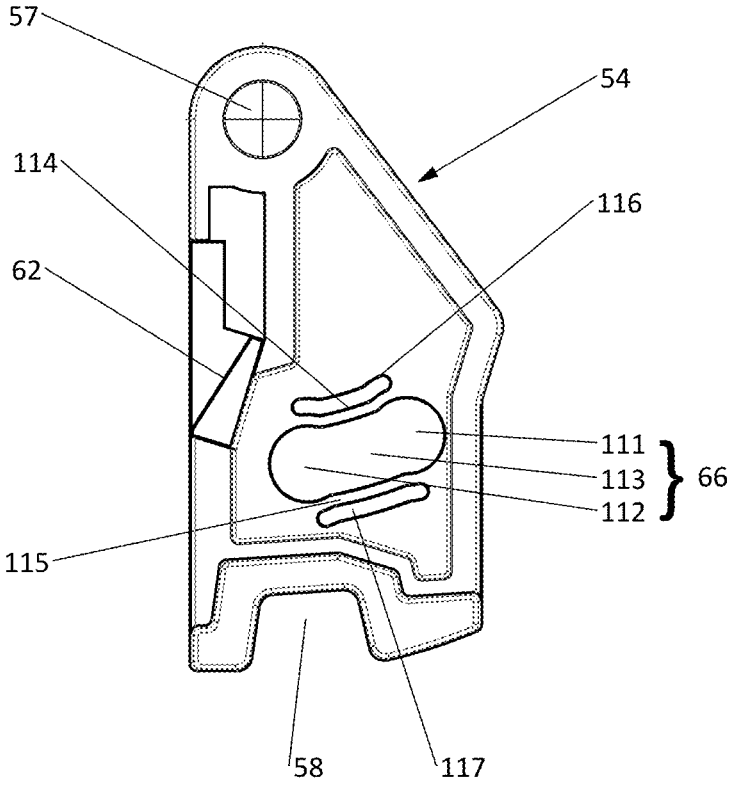
FIG. 10 shows a front view of the pawl locking member.

The shape of the slot 66 is best illustrated in FIG. 10 which shows a front view of the pawl locking member 54. The groove 66 has a specific shape with a narrower central part 113 and larger (compared to the central part 113) end regions 111, 112. The narrower central part 113 is caused by inwardly positioned ridges 114, 115. Besides these ridges 114, 115, there is provided a groove or opening 116, 117 in the pawl locking member 54. More generally, the groove or opening 116, 117 may be formed by a local weakening of the pawl locking member 54 in order to allow the ridges 114, 115 to be displaced outwards due to the pin 67 moving between the end regions 111, 112 upon actuation of the key cylinder 51. The ridges 114, 115 are resilient and urge the pin 67 to either one of the end regions 111, 112. As such, the specific shape forms a bi-stable pawl locking member 54.

The locking mechanism further comprises a pawl 59 that is mounted on the pawl locking member 54. More specifically, the pawl 59 has an opening 60 with the pin 55 also being placed through this opening 60 to mount the pawl 59 to the pawl locking member 54 and the frame 32. The pin 55 thus also forms a pivot around which the pawl 59 is able to rotate between a rest position with respect to the pawl locking member 54 (shown in FIGS. 7A, 7C, 8A and 8C) and a displaced position with respect to the pawl locking member 54 (shown in FIGS. 7B and 8B). The pawl locking member 54 is provided with an abutment 62 which defines the rest position of the pawl 59, i.e. in the rest position the pawl 59 abuts against the abutment 62 provided on the pawl locking member 54. A spring 61 is disposed between the pawl locking member 54 and the pawl 59 in order to urge the pawl 59 into its rest position with respect to the pawl locking member 54, i.e. pushing the pawl 59 against the abutment 62. The spring 61 is a torsion spring having a first end 61*a* that engages the pawl locking member 54 and a second end 61*b* that engages the pawl 59. The pawl 59 further comprises an abutment surface 63 against which the top surface 64 of the horizontal plate 39 (which is part of the upper link rod 33) may abut.

Figure 7A:
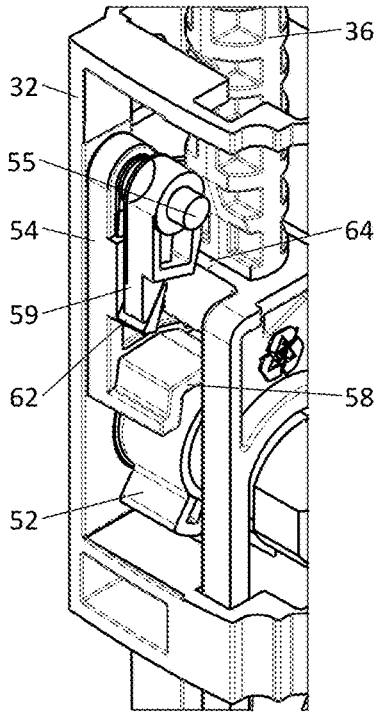
FIG. 7A shows a perspective view of the top part of the latch bolt assembly of FIG. 2 with the housing having been removed, with the locking mechanism in its unlocking position and with the knob in its rest position.

The locking mechanism operates in the following way. When the key cylinder 51 is unlocked (as shown in FIGS. 7A and 8A), the pawl 59 is in its rest position with respect to the pawl locking member 54 which itself is located in its first position. The abutment surface 63 of the pawl 59 is positioned next to the top surface 64 of the horizontal plate 39 which is part of the upper link rod 33. As such, the pawl 59 is in its retracted position and normal operation (i.e. an upwards translation upon pulling the knob 8) of the upper link member 33 is possible as shown in FIGS. 7A and 8A. For this reason, the first position of the pawl locking member 54 is also referred to as the locking position since the pawl 59 is locked in its retracted position with respect to the upper link member 33 and normal operation is allowed. Actuating the key cylinder 51 causes a rotation of the rotary driving bit 52 in a locking direction 65 (indicated in FIG. 8A) and causes the pawl locking member 54 to be rotated towards its second position. The pawl 59 remains stationary with respect to the pawl locking member 54 and thus remains in its rest position. The abutment surface 63 of the pawl 59 is positioned above the top surface 64 of the horizontal plate 39 which is part of the upper link rod 33. As such, the pawl 59 is in its extended position and normal operation (i.e. an upwards translation upon pulling the knob 8) of the upper link member 33 is prevented as shown in FIGS. 7C and 8C. Actuating the key cylinder 51 causes a rotation of the rotary driving bit 52 in a unlocking direction 68 (indicated in FIG. 8C) and causes the pawl locking member 54 to be rotated towards its first position shown in FIG. 8A thereby again allowing normal operation.

Figure 7B:
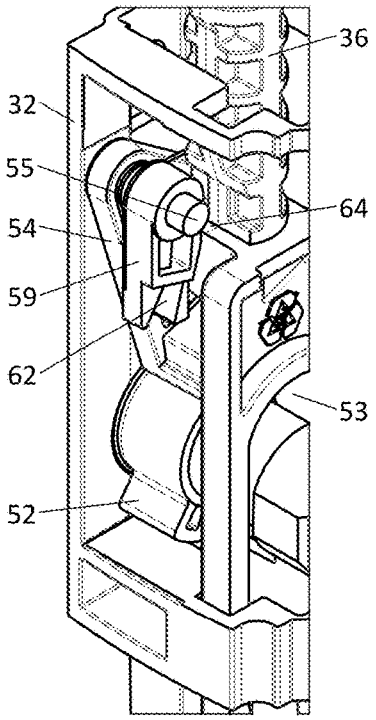
FIG. 7B shows a similar view as FIG. 7A but with the locking mechanism in its locking position and with the knob between its actuated and its rest position.
Figure 7C:
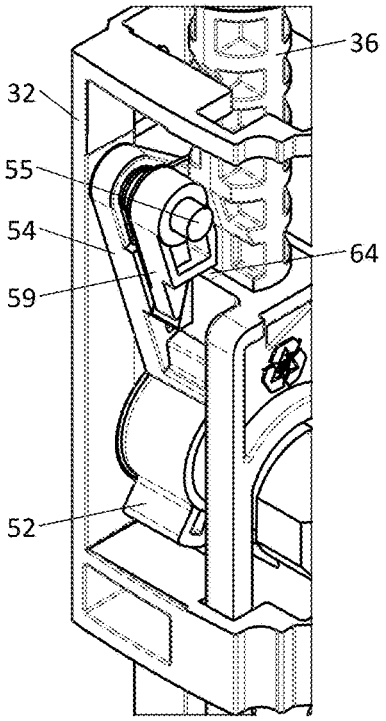
FIG. 7C shows a similar view as FIG. 7B but with the locking mechanism in its locking position and with the knob in its rest position.

The main advantage of the pawl 59 and the pawl locking member 54 is to avoid blocking the knob 8 in the actuated (i.e. upwards) position when the key cylinder 51 is actuated while the knob 8 is kept upwards by the user as illustrated in FIGS. 7B and 8B. More specifically, in case the knob 8 is pulled upwards (i.e. the upper link rod 33 is in an upwards position) and the key cylinder 51 is actuated to move the pawl locking member 54 to its second position, a pawl that is fixed on the pawl locking member 54 would prevent the knob 8 being pulled downwards by gravity to its rest position. However, as the pawl 59 is rotatable with respect to the pawl locking member 54, the downwards motion of the knob 8 and the upper link rod 33 (i.e. the horizontal plate 39) pushes the pawl 59 (in particular against the side surface 102 of the pawl 59) to the side (i.e. against the spring 61). Once the horizontal plate 39 has passed the pawl 59, the spring 61 pushes the pawl 59 against the abutment surface 62 on the pawl locking member 54 to its locking position illustrated in FIGS. 7C and 8C. For this reason, the second position of the pawl locking member 54 is also referred to as the release position since the pawl 59 is released and is free to be moved from its extended to its retracted position by the downwards motion of the knob 8.

It will be appreciated that variations of the construction of the pawl 59 and/or the pawl locking member 54 are possible. For example, the spring 61 may be interposed between the pawl 59 and the frame 62, the pawl 59 and/or the pawl locking member 54 may undergo a translational motion instead of a rotary motion, the pawl 59 and the pawl locking member 54 may be mounted on different rotational axes, the pawl 59 may engage another part of the upper link rod 33, etc.

It will be readily appreciated that various modifications are possible in which the advantages of the second-order lever between the link rods 33, 34 and/or of the locking mechanism are also obtained. For example, in an embodiment, the magnetic roles of the latch bolt 14 and the magnet 19 are reversed. In other words, the latch bolt 14 is a permanent magnet and element 19 is made from a ferromagnetic material (e.g. iron). The operation of the magnetic latch assembly 1 remains unaffected because the latch bolt 14 will still be attracted to the element 19 as this is fixedly positioned within the keeper assembly 6. Moreover, it is also possible that the latch bolt 14 and the magnet 19 are permanent magnets and/or electromagnets. In another embodiment, the latch bolt 14, coupler 15 and latch bolt spring 17 are replaced by a magnetic element fixed to the lower end 34*a* of the lower link rod 34. The keeper assembly 6 is replaced by a latch bolt assembly having a horizontally oriented latch bolt that is biased towards its retracted position and is attracted by the magnetic element fixed to the lower end 34*a*. Such embodiments are disclosed in AU 2009/251007 A1, AU 2013/206766 A1, 2014/203446 A1, AU 2016/201778 A1, and AU 2018/256525 A1. Furthermore, it is also possible to reverse the roles of the magnet and the latch bolt in such an embodiment, i.e. have the horizontal latch bolt form the permanent magnet and have a ferromagnetic material fixed to the lower end 34*a* of the lower link rod 34. Moreover, the position of the latch bolt assembly 5 and the keeper assembly 6 may also be reversed, i.e. the latch bolt assembly 5 may be mounted on the closure member 2 and the keeper assembly 6 on the support 4.

Although aspects of the present disclosure have been described with respect to specific embodiments, it will be readily appreciated that these aspects may be implemented in other forms within the scope of the invention as defined by the claims.

The invention claimed is:

1. A magnetic latch for fastening a closure member to a support, the magnetic latch comprising a latch bolt assembly configured to be mounted to one of the closure member and the support and a keeper assembly configured to be mounted to the other one of the closure member and the support, the keeper assembly comprising a first magnetic element and the latch bolt assembly comprising:

an elongated frame extending in a vertical direction and having two opposing extremities;

a latch bolt mounted on the frame at a first one of said two extremities and being moveable between a latching position and a retracted position, the latch bolt comprising a second magnetic element;

a latch bolt biasing member arranged to urge the latch bolt into its retracted position, wherein the first magnetic element and the second magnetic element are configured to magnetically attract each other to move the latch bolt into its latching position against the latch bolt biasing member; and a latch bolt operating mechanism including an actuator mounted on the frame at a second one of said two extremities, the latch bolt operating mechanism being configured to, upon actuation of the actuator, move the latch bolt from its latching position to its retracted position against the magnetic attraction between said first and said second magnetic element, wherein the latch bolt operating mechanism comprises:

an effort link rod extending in the vertical direction and coupled to the actuator and moveable by a translational motion along the vertical direction from a rest position to an actuated position upon actuation of the actuator;

a load link rod extending in the vertical direction and coupled to the latch bolt and moveable by a translational motion along the vertical direction from a rest position to an actuated position upon actuation of the actuator; and a second-order lever interposed between the effort link rod and the load link rod and rotatable about a fulcrum mounted on the frame between a rest position and an actuated position, wherein the second-order lever has a fulcrum with the load link rod being closer to the fulcrum than the effort link rod.

2. The magnetic latch according to claim 1, wherein the second-order lever is rotatable in a plane between its rest position and its actuated position, the plane having a component in the vertical direction and in a horizontal direction, the second-order lever being slideable in the horizontal direction with respect to effort link rod and/or the load link rod and/or the frame.

3. The magnetic latch according to claim 2, wherein the second-order lever comprises a fulcrum opening, an effort opening, and a load opening, the fulcrum being disposed in the fulcrum opening, the effort link rod being connected to the second-order lever by a transverse pin disposed in the effort opening and the load link rod being connected to the second-order lever by a transverse pin disposed in the load opening.

4. The magnetic latch according to claim 3, wherein at least two of the fulcrum opening, the effort opening, and the load opening are elongated in the horizontal direction.

5. The magnetic latch according to claim 1, wherein the second-order lever comprises a fulcrum opening, an effort opening, and a load opening, the fulcrum being disposed in the fulcrum opening, the effort link rod being connected to the second-order lever by a transverse pin disposed in the effort opening and the load link rod being connected to the second-order lever by a transverse pin disposed in the load opening.

6. The magnetic latch according to claim 1, wherein the latch bolt operating mechanism further comprises a slideable coupler disposed between the load link rod and the latch bolt and moveable, by a translational motion along the vertical direction, between a releasing position in which the load link rod does not engage the slideable coupler and an engaging position in which the load link rod engages the slideable coupler, and in that the releasing position of the slideable coupler corresponds to the retracted position of the latch bolt and the engaging position of the slideable coupler corresponding to the extended position of the latch bolt.

7. The magnetic latch according to claim 6, characterized in that the load link rod has a widened lower end and in that slideable coupler comprises a vertically oriented groove in which the widened lower end is positioned and an assembly opening adjacent the vertically oriented groove, wherein the load link rod is connected to the slideable coupler by placing the widened lower end in the assembly opening and afterwards rotating the load link rod to allow the widened lower end to be slid into the vertically oriented groove.

8. The magnetic latch according to claim 1, wherein the actuator is directly connected to the effort link rod.

9. The magnetic latch according to claim 6, characterized in that the actuator is connected to the effort link rod by an angular snap-fit joint, the actuator preferably comprising an internal chamber into which a locally widened end of the effort link rod is positioned.

10. The magnetic latch according to claim 1, wherein the latch bolt is moveable in the vertical direction between its latching position and its retracted position by a translational motion along the vertical direction.

11. The magnetic latch according to claim 10, wherein the latch bolt operating mechanism further comprises a slideable coupler disposed between the load link rod and the latch bolt and moveable, by a translational motion along the vertical direction, between a releasing position in which the load link rod does not engage the slideable coupler and an engaging position in which the load link rod engages the slideable coupler, and in that the releasing position of the slideable coupler corresponds to the retracted position of the latch bolt and the engaging position of the slideable coupler corresponding to the extended position of the latch bolt, that latch bolt being fixedly connected to the slideable coupler.

12. The magnetic latch according to claim 11, wherein the latch bolt comprises a circumferential groove, the latch bolt being connected to the slideably coupler by a pin which is partially positioned within the circumferential groove.

13. The magnetic latch according to claim 11, wherein the latch bolt biasing member comprises a compression spring having a first end engaging the slideable coupler and a second end engaging the frame.

14. A magnetic latch for fastening a closure member to a support, the magnetic latch comprising a latch bolt assembly configured to be mounted to one of the closure member and the support and a keeper assembly configured to be mounted to the other one of the closure member and the support, the latch bolt assembly comprising:

a latch bolt moveable between a latching position and a retracted position, the latch bolt comprising a first magnetic element; and a latch bolt biasing member arranged to urge the latch bolt into its retracted position, the keeper assembly comprising:

an elongated frame extending in a vertical direction and having two opposing extremities;

a second magnetic element mounted on the frame at a first one of said two extremities and being moveable between a rest position in which the first magnetic element and the second magnetic element magnetically attract each other to move the latch bolt into its latching position against the latch bolt biasing member and an actuated position; and an operating mechanism including an actuator mounted on the frame at a second one of said two extremities, the operating mechanism being configured to, upon actuation of the actuator, move the second magnetic element from its rest position to its actuated position, wherein the operating mechanism comprises:

an effort link rod extending in the vertical direction and coupled to the actuator and moveable by a translational motion along the vertical direction from a rest position to an actuated position upon actuation of the actuator;

a load link rod extending in the vertical direction and coupled to the second magnetic element and moveable by a translational motion along the vertical direction from a rest position to an actuated position upon actuation of the actuator; and a second-order lever interposed between the effort and the load link rod and rotatable about a fulcrum mounted on the frame between a rest position and an actuated position, wherein the second-order lever has a fulcrum with the load link rod being closer to the fulcrum than the effort link rod.

* * * * *